US006015277A

United States Patent [19]

Richardson, Jr.

[11] Patent Number: 6,015,277

[45] Date of Patent: Jan. 18, 2000

[54] FABRICATION METHOD FOR SEMICONDUCTOR SUBSTRATE

[75] Inventor: Hubert Richardson, Jr., Brooklyn, Mich.

[73] Assignee: Tecumseh Products Company, Tecumseh, Mich.

[21] Appl. No.: 08/969,379

[22] Filed: Nov. 13, 1997

[51] Int. Cl.[7] ..... F01C 1/02

[52] U.S. Cl. ..... 418/55.4; 418/55.5; 418/57

[58] Field of Search ..... 418/55.4, 55.5, 418/57

[56] References Cited

U.S. PATENT DOCUMENTS

| | | | |
|---|---|---|---|
| Re. 33,473 | 12/1990 | Hazaki et al. | 418/55.5 |
| 4,350,479 | 9/1982 | Tojo et al. | 418/55 |
| 4,357,132 | 11/1982 | Kousokabe | 418/55 |
| 4,365,941 | 12/1982 | Tojo et al. | 417/372 |
| 4,384,831 | 5/1983 | Ikegawa et al. | 418/55 |
| 4,473,343 | 9/1984 | Hazaki et al. | 418/55 |
| 4,475,874 | 10/1984 | Sato | 418/55 |
| 4,496,296 | 1/1985 | Arai et al. | 418/55 |
| 4,557,675 | 12/1985 | Murayama et al. | 418/55 |
| 4,611,975 | 9/1986 | Blain | 418/5 |
| 4,696,630 | 9/1987 | Sakata et al. | 418/55 |
| 4,743,181 | 5/1988 | Murayama et al. | 418/55 |
| 4,795,322 | 1/1989 | Etemad et al. | 418/55 |
| 4,818,198 | 4/1989 | Tamura et al. | 418/55 |
| 4,861,245 | 8/1989 | Tojo et al. | 418/55 |
| 4,968,232 | 11/1990 | Kikuchi | 418/55.5 |
| 4,992,032 | 2/1991 | Barito et al. | 418/55.4 |
| 4,993,928 | 2/1991 | Fraser, Jr. | 418/55.4 |
| 4,997,350 | 3/1991 | Tamura et al. | 418/55.6 |
| 5,082,432 | 1/1992 | Kikuchi | 418/55.5 |
| 5,085,565 | 2/1992 | Barito | 418/55.4 |
| 5,252,046 | 10/1993 | Wen-Ding et al. | 418/55.5 |
| 5,256,044 | 10/1993 | Nieter et al. | 428/55.5 |
| 5,329,788 | 7/1994 | Caillat et al. | 62/505 |
| 5,447,420 | 9/1995 | Caillat et al. | 418/55.5 |
| 5,478,219 | 12/1995 | Nardone et al. | 418/55.5 X |
| 5,660,539 | 8/1997 | Matsunaga et al. | 418/55.5 X |
| 5,720,602 | 2/1998 | Hill et al. | 418/55.5 X |
| 5,873,711 | 2/1999 | Lifson | 418/55.5 X |

*Primary Examiner*—Hoang Nguyen
*Attorney, Agent, or Firm*—Baker & Daniels

[57] ABSTRACT

A scroll compressor includes a scroll set in which fluids at various operating pressures impart a plurality of forces on the scroll set orbiting and fixed scroll members. An axial biasing force is applied against the orbiting scroll member urging same toward the fixed scroll member. Fluid at discharge pressure exerts an axial force at a first area of the back surface of the orbiting scroll member which urges the orbiting scroll member toward the fixed scroll member to maintain axial compliance therebetween and to prevent leakage of compressed refrigerant fluid during compressor operation. An axial anti-biasing force is applied between the orbiting and fixed scroll members to urge them apart. An annular chamber provided between the end plates of the orbiting and fixed scroll members forms a cavity that is in communication with fluid contained in pockets of compression in the scroll set. The fluid in the pockets of compression is at a pressure intermediate discharge and suction pressures. A passage provided in the scroll set communicates the intermediate pressure fluid from the pockets of compression to the intermediate pressure cavity. The intermediate pressure fluid acts upon the opposing face surfaces of the orbiting and fixed scroll members urging them apart. In this manner, an unbiasing force is exerted between the scroll members to offset excessive axial biasing forces which may act upon the orbiting scroll member, thereby preventing excessive wear and power consumption and providing enhanced operating efficiency. The intermediate force effectively acts as a cushion to lessen the biasing force at the higher end of the operating range.

28 Claims, 4 Drawing Sheets

FABRICATION METHOD FOR SEMICONDUCTOR SUBSTRATE

BACKGROUND OF THE INVENTION

The invention generally relates to hermetic compressors of the scroll type having a scroll mechanism which receives refrigerant at a suction pressure, compresses the received refrigerant, and discharges the compressed refrigerant at an elevated discharge pressure. Such scroll compressors are typically used in refrigeration, air conditioning and other such systems. The typical scroll mechanism includes an orbiting scroll member and a fixed scroll member, but may in an alternative form comprise co-rotating scroll members. Wraps are provided on each of the scroll members and face and intermesh with each other in an orbiting fashion so as to form pockets of compression during compressor operation.

Scroll compressors take various forms, such as high-side type compressors, wherein the internal volume of the compressor housing is primarily at discharge pressure, and low-side type compressors, wherein the internal volume is primarily at suction pressure. Efficiency in scroll mechanisms is primarily dependent upon maintaining pockets of compressed refrigerant gas during the compression cycle through to discharge with minimal leakage while consuming the least amount of energy to do so. Accordingly, it is extremely important to maintain the scroll set in a tight sealed relationship during compressor operation by maintaining the scroll set both radially and axially compliant. Typically, when the head pressure becomes extremely high the centrifugal forces that act to keep the scroll set radially compliant are overwhelmed and radial separation occurs. When the head pressure is very low axial separation may occur.

During compressor operation, pockets of compressed gas within the scroll set act upon the wraps so as to urge them axially apart. Separation of the scroll members results in leakage and inefficient compressor operation. Preventing scroll member separation is not simply a matter of applying a pressure on the back surface of the orbiting scroll which is sufficient to maintain contact of the tips of the scroll wraps with the inside face surfaces of the scroll members. Excessive wear on the tips of the scroll wraps occurs when excessive force is applied to the back of the orbiting scroll. The compressor must operate over a wide range of operating extremes which are somewhat dependent on the refrigerant system load connected to the compressor. At the high end of the compressor's operating range pressures are at their highest and, especially in a high-side design, the axial forces become greater and greater and the radial compliance force becomes less and less until leakage occurs due to the failure to maintain radial compliance. At the low end of the operating range the axial forces become less and less until they are insufficient to keep the scroll set tightly engaged and leakage occurs due to the failure to maintain axial compliance.

The pressure exerted against the back of the orbiting scroll member must be great enough to maintain tip to surface contact, while being not so great so as to cause excessive wear and power consumption and further operating inefficiencies. Some compressors have been arranged so that fluid at discharge pressure is applied at a portion of the orbiting scroll member and fluid at suction pressure are applied at a second portion of the orbiting scroll member. Other attempts have been made to apply fluid at a varying, intermediate pressure, alone or in conjunction with fluid at discharge and/or suction pressures, against the back of the orbiting scroll so as to expand the operating range of the compressor.

U.S. Pat. No. 4,475,874 (Sato) discloses a scroll compressor arranged to introduce an intermediate pressure gas from pockets of compression formed in the scroll set during compressor operation into a housing chamber formed in a compressor mechanism housing. The intermediate pressure fluid, at some level between discharge and suction pressures, is applied against the back surface of the orbiting scroll member so as to provide an axial biasing force which urges the orbiting scroll member tightly against the fixed scroll member. The intermediate pressure fluid is introduced into the housing chamber via at least one aperture provided in the end plate of one of the two scroll members. This in effect introduces a controlled leak from the scroll set to the intermediate pressure housing chamber. One disadvantage to this design is that it relies solely upon the fluid at intermediate pressure to provide the necessary upwards axial biasing force, and utilizes a relatively large volume of such fluid which must be drawn from the pockets of compression. This reduces the efficiency of the compressor mechanism.

U.S. Pat. No. Re. 33,473 (Hazaki) discloses a high-side scroll compressor having an oil passage which extends the length of the crankshaft for communicating oil from the sump to an oil chamber defined by the rear surface of the hub portion of the orbiting scroll member and the upper surface of the crank portion of the shaft. The sump and the oil in the oil chamber are at discharge pressure. Seals are used to isolate an intermediate pressure chamber, defined by the crankshaft, the frame, and the back surface of the orbiting scroll member, from discharge and suction pressures. At least one passage is formed in the orbiting scroll plate to communicate partially compressed gas from pockets of compression formed in the scroll set to the intermediate pressure chamber. The intermediate pressure gas that fills the intermediate chamber during compressor operation acts upon the rear surface of the orbiting scroll so as to urge it toward the fixed scroll member. The pressure level of the intermediate pressure gas is somewhat dependent upon the pressure of the suction gas entering the scroll set.

U.S. Pat. No. 4,384,831 (Ikegawa et al.) and U.S. Pat. No. 4,350,479 (Tojo et al.) disclose a scroll compressor having a liquid supply source that delivers oil under pressure via passages formed in the fixed scroll to a plurality of liquid confining pockets formed about the periphery of the interface of the scroll set for applying a force opposite to a localized high axial urging force. The force effected by the liquid source is provided to negate any moment resulting from the localized high axial force exerted on the orbiting scroll member during compressor operation. An intermediate pressure gas is delivered to a chamber defined by the frame, the back surface of the orbiting scroll member and the crankshaft via a pressure reducing valve which is connected to discharge pressure gas.

SUMMARY OF THE INVENTION

The scroll compressor of the present invention consists generally of a scroll set wherein multiple pressures are applied both against the back surface of the orbiting scroll member and between the upper surface of the orbiting scroll member and the facing surface of the fixed scroll member. Fluid at discharge pressure is applied at the back surface of the inner portion of the orbiting scroll and fluid at suction pressure, or some pressure less than discharge pressure, is applied at the back surface of the outer portion of the orbiting scroll member. The discharge pressure fluid urges the orbiting scroll member toward the fixed scroll member to maintain axial compliance therebetween and to prevent leakage of compressed refrigerant fluid during compressor operation. An annular chamber provided in either of the facing surfaces of the orbiting and fixed scroll members forms a cavity that is in communication with fluid contained in pockets of compression in the scroll set. The fluid in the pockets of compression is at a pressure intermediate discharge and suction pressures. A passage is provided in the orbiting scroll plate to communicate the intermediate pressure fluid from the pockets of compression to the intermediate pressure cavity. The intermediate pressure fluid acts upon the upper surface of the orbiting scroll member and the facing surface of the fixed scroll member so as to urge the scroll members apart. In this manner, an unbiasing force is exerted between the scroll members to offset excessive axial biasing forces which may act upon the orbiting scroll member, thereby preventing excessive wear and power consumption and providing enhanced operating efficiency.

The introduction of an intermediate anti-biasing or unbiasing force provides a cushion against excessive axial biasing forces and provides additional control over the biasing forces to enlarge the operating envelope of the compressor. The intermediate force effectively lessens the biasing force at the higher end of the operating range. At the lower end of the operating range in order to maintain the axial biasing force necessary to maintain axial compliance it is important to 1) most effectively locate the seal which separates the back surface into discharge and suction pressure areas, and 2) most effectively locate the intermediate pressure bleed aperture in the scroll set and size the area associated with the intermediate pressure cavity so that the discharge pressure area is sufficient at low operating pressure conditions to maintain the intimate contact between the scroll members, thereby preventing leakage. Accordingly, the lower end of the operating range is set by the design of the high pressure and intermediate pressure pockets and the location of the intermediate pressure aperture.

One advantage associated with the present invention is that a more versatile scroll compressor arrangement is provided, especially for high-side applications, which expands the operational envelope of the compressor to prevent leakage and excessive wear at extreme operating conditions and to provide a more efficient compressor.

Another advantage associated with the present invention is that in the case of high-side type compressors only a small volume of intermediate pressure is needed in the design of the present invention as compared to prior art designs which relied solely upon intermediate pressure to provide an axial biasing force and required a relatively large volume of intermediate pressure fluid to be drawn from the pockets of compression.

Yet one more advantage of the present invention is that in high-side applications the upwards, axial biasing force is initially set by choosing the location of the seal intermediate the back surface of the orbiting scroll plate and the bearing frame. Once the location of the seal is decided upon, and hence the area of the back surface of the orbiting scroll member exposed to discharge pressure, the location of the intermediate pressure aperture and the size of the intermediate cavity (surface areas on the scroll members) may be derived based upon the lowest compression ratio of the operating range to achieve the proper balance of axial biasing and unbiasing forces.

In one embodiment, the invention provides a scroll compressor having an orbiting scroll member and a fixed scroll member each having an end plate and a spiral wrap protruding perpendicularly from the end plate. The scroll members are assembled so that the wraps face one another and mesh with one another so as to define therebetween pockets of compression, also referred to as compression chambers, which are formed during compressor operation. The scroll compressor includes an apparatus for providing orbital movement of the orbiting scroll member relative to the fixed scroll member. During orbital movement of the orbiting scroll member the scroll members draw in refrigerant at suction pressure from a suction port, form pockets of compression in which such refrigerant is compressed, and discharge compressed refrigerant through a discharge port. The orbital movement causes the volumes of the pockets of compression to progressively decrease as the pockets are progressed along the scroll members towards the discharge port. An intermediate pressure chamber is provided between the orbiting scroll member and the fixed scroll member. An axial compliance pressure chamber is provided which contains pressurized fluid which acts on one of the orbiting and fixed scroll members so as to urge said scroll members together. At least one passageway is provided in at least one of the orbiting and fixed scroll members and is in communication with the pockets of compression and the intermediate pressure chamber. Fluid from the pockets of compression provides an anti-biasing force within the intermediate pressure chamber to offset excessive axial biasing forces imparted against the orbiting scroll member urging it toward the fixed scroll member.

BRIEF DESCRIPTION OF THE DRAWINGS

The above-mentioned and other features and objects of this invention, and the manner of attaining them, will become more apparent and the invention itself will be better understood by reference to the following description of an embodiment of the invention taken in conjunction with the accompanying drawings, wherein.

Figure 1:
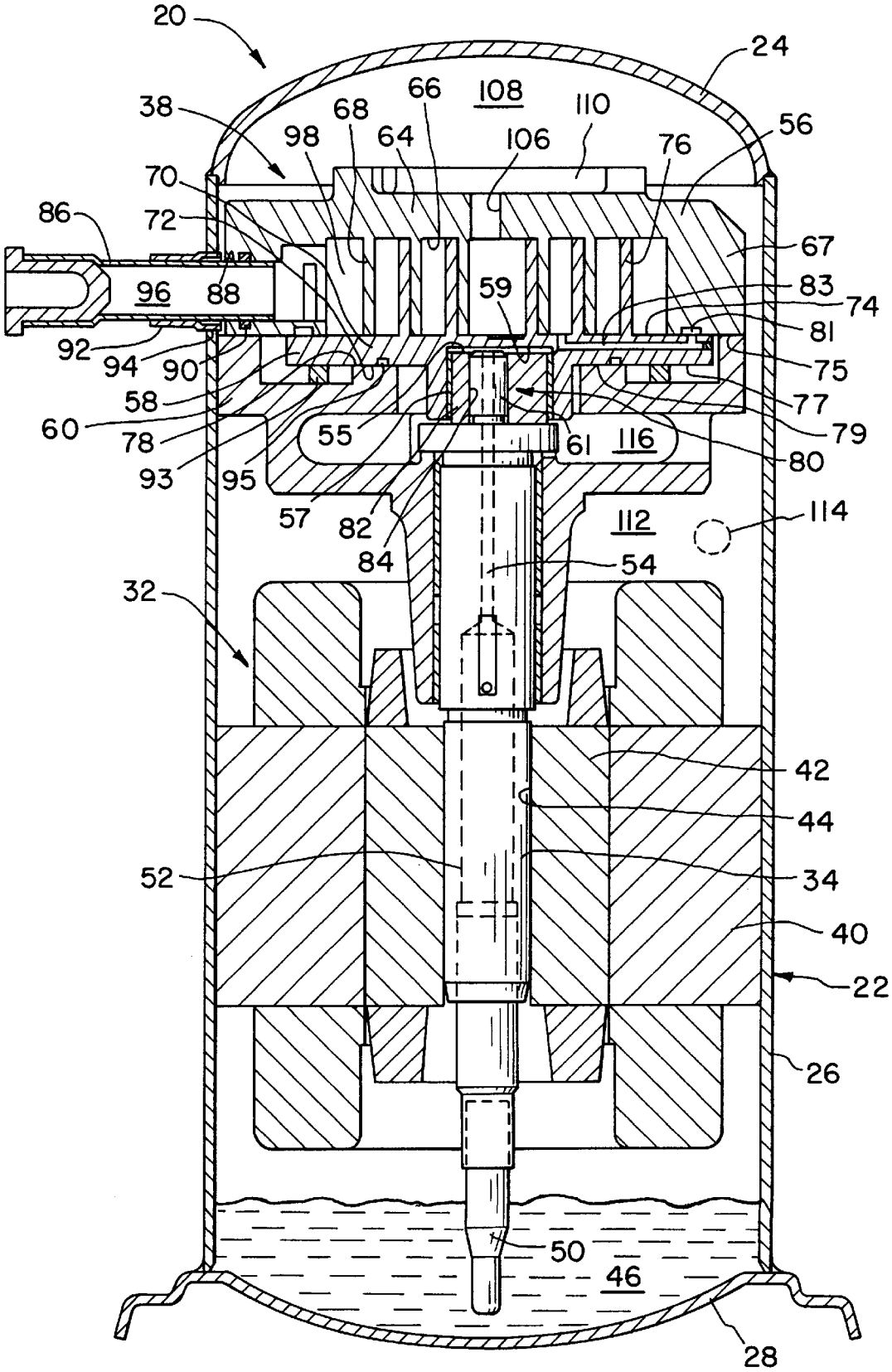
FIG. 1 is a cross-sectional view of the scroll compressor of the present invention.

Corresponding reference characters indicate corresponding parts throughout the several views. The exemplifications set out herein illustrate a preferred embodiment of the invention, in one form thereof, and such exemplifications are not to be construed as limiting he scope of the invention in any manner.

DETAILED DESCRIPTION OF THE INVENTION

In an exemplary embodiment of the invention as shown in the drawings, scroll compressor 20 is shown in one vertical shaft embodiment. This embodiment is only provided as an example to which the invention is not limited. U.S. Pat. No. 5,306,126, issued to the assignee of the present invention and incorporated herein by reference, provides a detailed description of the operation of a scroll compressor which is compatible with the present invention.

Referring now to FIG. 1, scroll compressor 20 is shown having housing 22 consisting of upper portion 24, central portion 26 and lower portion 28. In an alternative form central portion 26 and lower portion 28 may be combined as a unitary lower housing member. Housing portions 24, 26, and 28 are hermetically sealed and secured together by such processes as welding or brazing. Lower housing member 28 also serves as a mounting flange for mounting compressor 20 in a vertical upright position. The present invention is also applicable in horizontal compressor arrangements. Within housing 22 is electric motor 32, crankshaft 34, and scroll mechanism 38. Motor 32 includes stator 40 and rotor 42 which has aperture 44 into which is received crankshaft 34. Oil collected in oil sump 46 is communicated by centrifugal oil pickup tube 50 along passageways 52 and 54, whereby it is delivered to and occupies oil chamber 55 and feeds down to lubricate upper rotational bearing 57.

Scroll compressor mechanism 38 generally comprises fixed scroll member 56, orbiting scroll member 58, and main bearing frame member 60. Fixed scroll member 56 is fixably secured to main bearing frame member 60 by a plurality of mounting bolts. Fixed scroll member 56 comprises generally flat end plate 64, face surface 66, sidewall 67 and an involute fixed wrap 68 which extends axially downward from surface 66. Orbiting scroll member 58 comprises generally flat end plate 70, having back surface 72 and top face surface 74, and involute orbiting wrap 76, which extends axially upward from top surface 74. With compressor 20 in a de-energized mode, back surface 72 of orbiting scroll plate 70 engages main bearing member 60 at thrust bearing surface 78.

Scroll mechanism 38 is assembled with fixed scroll member 56 and orbiting scroll member 58 intermeshed so that fixed wrap 68 and orbiting wrap 76 operatively interfit with each other. To insure proper compressor operation, face surfaces 66 and 74 and wraps 68 and 76 are manufactured so that when fixed scroll member 56 and orbiting scroll member 58 are forced axially toward one another, the tips of wraps 68 and 76 sealingly engage with respective opposite face surfaces 66 and 74. During compressor operation back surface 72 of orbiting scroll member 58 becomes axially spaced from thrust surface 78 in accordance with strict machining tolerances and the amount of permitted axial movement of orbiting scroll member 58 toward fixed scroll member 56. Situated on the top of crankshaft 34 about offset crank pin 61 is eccentric crank mechanism 80 which consists of cylindrical roller 82 having offset axial bore 84 which receives the offset crank pin. When crankshaft 34 is caused to rotate by motor 32, cylindrical roller 82 and Oldham ring 93 cause orbiting scroll member 58 to orbit with respect to fixed scroll member 56. In this manner eccentric crank mechanism 80 functions as a conventional swing-link radial compliance mechanism to promote sealing engagement between fixed wrap 68 and orbiting wrap 76.

With compressor 20 in operation, refrigerant fluid at suction pressure is introduced through suction tube 86, which is sealingly received into counterbore 88 in fixed scroll member 56. The sealing of suction tube 86 with counterbore 88 is aided by the use of O-ring 90. Suction tube 86 is secured to compressor 20 by suction tube adapter 92 which is brazed or soldered to suction tube 86 and opening 94 of housing 22. Suction tube 86 includes suction pressure refrigerant passage 96 through which refrigerant fluid is communicated from refrigeration system, or other such system, to suction pressure chamber 98 which is defined by fixed scroll member 56 and frame member 60. A suction port provided in fixed scroll member 56 receives suction tube 86 and annular O-ring 90 in a groove for proper sealing of suction tube 86 with fixed scroll 56.

Suction pressure refrigerant travels along suction passage 96 and enters suction chamber 98 for compression by scroll mechanism 38. As orbiting scroll member 58 is caused to orbit with respect to fixed scroll member 56, refrigerant fluid within suction chamber 98 is captured and forms closed pockets of compressed refrigerant as defined by fixed wrap 68 and orbiting wrap 76. As orbiting scroll member 58 continues to orbit, pockets of refrigerant are progressed radially inwardly towards discharge port 106. As the refrigerant pockets are progressed along scroll wraps 68 and 76 towards discharge port 106 their volumes are progressively decreased, thereby causing an increase in refrigerant pressure. This increase in pressure internal the scroll set results in an axial force which acts outwardly to separate the scroll members. If this axial separating force becomes excessive, it may cause the tips of the scroll wraps to become spatially removed from the scroll plates resulting in leakage without the pockets of compression and loss of efficiency. An axial biasing force, discussed hereinbelow, is applied against the back of at least one of the two scroll members to overcome the axial separating force within the scroll set to maintain the pockets of compression. However, should the axial biasing force become excessive then further inefficiencies are the result. Accordingly, all forces which act upon the scroll set must be considered and taken into account when designing an effective compressor design which effects a sufficient, yet not excessive, axial biasing force.

Upon completion of the compression cycle within the scroll set, refrigerant fluid at discharge pressure is discharged upwardly through discharge port 106 and is communicated through face plate 64 of fixed scroll member 56. The refrigerant is expelled into discharge plenum chamber 108 as defined by upper housing portion 24 and top surface 110 of fixed scroll member 56. The compressed refrigerant is introduced into housing chamber 112 where it exits through discharge tube 114 into a system, such as a refrigeration or air-conditioning system, in which compressor 20 is incorporated.

To illustrate the relationship between the various fluids at varying pressures which occur inside compressor 20 during normal operation, we shall examine the example of the compressor in a typical refrigeration system. When refrigerant flows through a conventional refrigeration system during the normal refrigeration cycle, the fluid drawn into the compressor at suction pressure undergoes changes as the load associated with the system varies. As the load increases, the suction pressure of the entering fluid increases and as the load decreases, the suction pressure decreases. Because the fluid which enters the scroll set, and eventually the pockets of compression formed therein, is at suction pressure, as the suction pressure varies, so varies the pressure of the fluid within the pockets of compression. Accordingly, as the suction pressure varies, i.e. increases or decreases, so to does the intermediate pressure within the pockets of compression, i.e. increases or decreases, respectively. The change in suction pressure results in a corresponding change in the axial separating forces within the scroll set. As the suction pressure decreases the axial separating force within the scroll set decreases and the requisite level of axial biasing force needed to maintain scroll set integrity decreases. Clearly this is a dynamic situation in which as the suction pressure varies the operating envelope of the compressor may vary. Because the axial anti-biasing force of the present invention is derived from the pockets of compression and therefore tracks the fluctuations in the suction pressure, an effective operating envelope for compressor 20 is maintained. The actual magnitude of the axial anti-biasing force is determined by the location of aperture 85 and the area of chamber 81.

Within scroll compressor 20, multiple pressures are applied against back surface 72 of orbiting scroll member 58 and between upper surface 74 of the orbiting scroll member and facing surface 75 of fixed scroll member 56. In the high-side configuration of compressor 20 described herein, fluid at discharge pressure is applied at inner portion 79 of back surface 72. Fluid at discharge pressure contained within chamber 55 exerts an upward, axial biasing force against hub portion 59 of back surface 72. Fluid at suction pressure, or some pressure less than discharge pressure, is applied at outer portion 77 of back surface 72. Inner portion 79 and outer portion 77, and their respective fluid pressures, are separated by annular seal 95. The axial biasing forces associated with the discharge pressure fluid urges orbiting scroll member 58 toward fixed scroll member 56 to maintain axial compliance therebetween and to prevent leakage of compressed refrigerant fluid during compressor operation. However, at certain conditions within the operating range of compressor 20, these axial biasing forces, if unchecked, may become too great and result in excessive wear and excessive power consumption.

Annular chamber 81 may be provided in either of the facing surfaces of the orbiting and fixed scroll members and is shown throughout the figures as being provided in fixed scroll member 56. Annular chamber 81 forms an intermediate pressure cavity that is in communication with fluid contained in pockets of compression formed in the scroll set. The fluid in the pockets of compression is at a pressure intermediate discharge and suction pressures. In one embodiment, oil and/or the natural sealing properties of the contact surfaces on either side of intermediate pressure cavity 81 will isolate intermediate pressure cavity 81 from adjacent volume 124 and the adjacent volume defined by the scroll set. In an alternative embodiment one or two annular seals may be provided on either side or both side surfaces between the scroll member.

Figure 2:
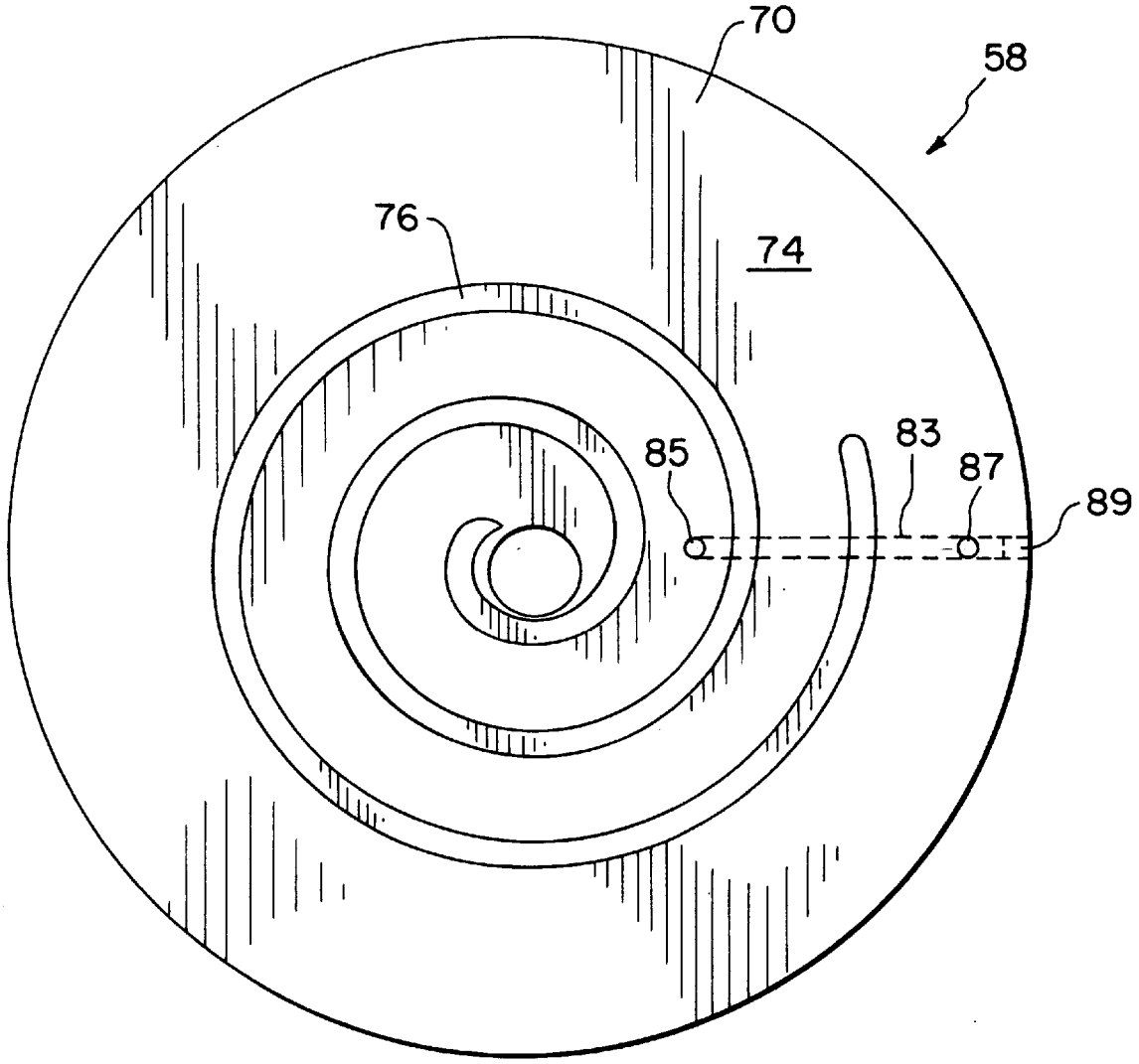
FIG. 2 is a top view of the orbiting scroll member of the scroll compressor of FIG. 1 showing the intermediate pressure fluid passage of the present invention.
Figure 3:
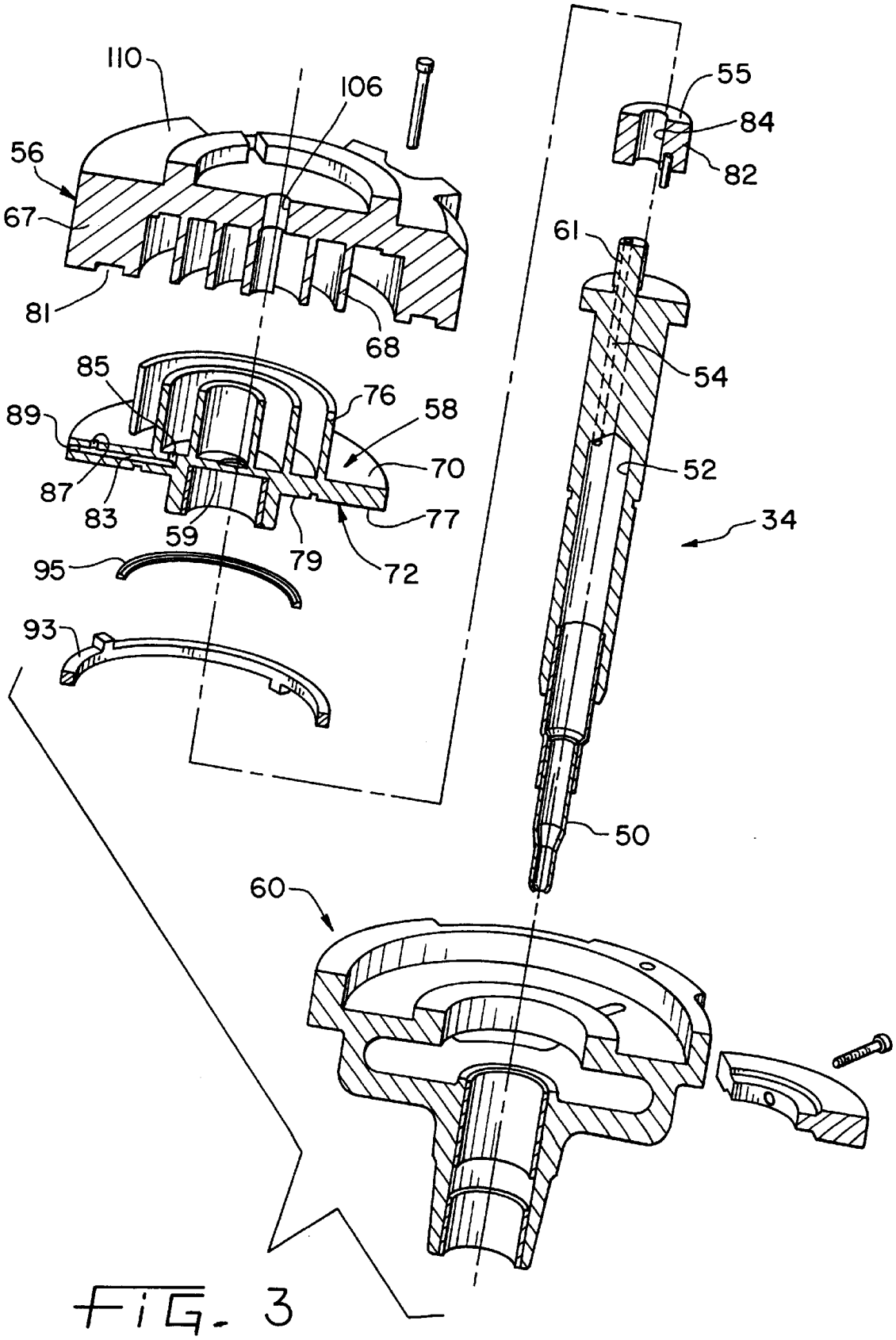
FIG. 3 is a cross-sectional, exploded view of the compressor mechanism of the compressor of FIG. 1 showing the intermediate pressure fluid passage and annular chamber of the present invention.

As shown in FIGS. 2 and 3, passage or conduit 83 is provided in plate portion 70 of orbiting scroll member 58 and communicates intermediate pressure fluid from the pockets of compression to intermediate pressure cavity 81. Aperture 85 connects passage 83 with the pockets of compression formed in the scroll set and aperture 87 connects passage 83 with the intermediate pressure cavity formed in sidewall 67 of fixed scroll member 56. The passage itself may form part of the intermediate chamber between the fixed and orbiting scroll members. Although this particular arrangement is described herein, it is by way of example only and not limitation. It should be understood that any number of suitable alternative arrangements, such as providing annular pressure cavity 81 in orbiting scroll member 58 or providing intermediate pressure passage 83 in fixed scroll member 56, are fully contemplated by the present invention.

Figure 4:
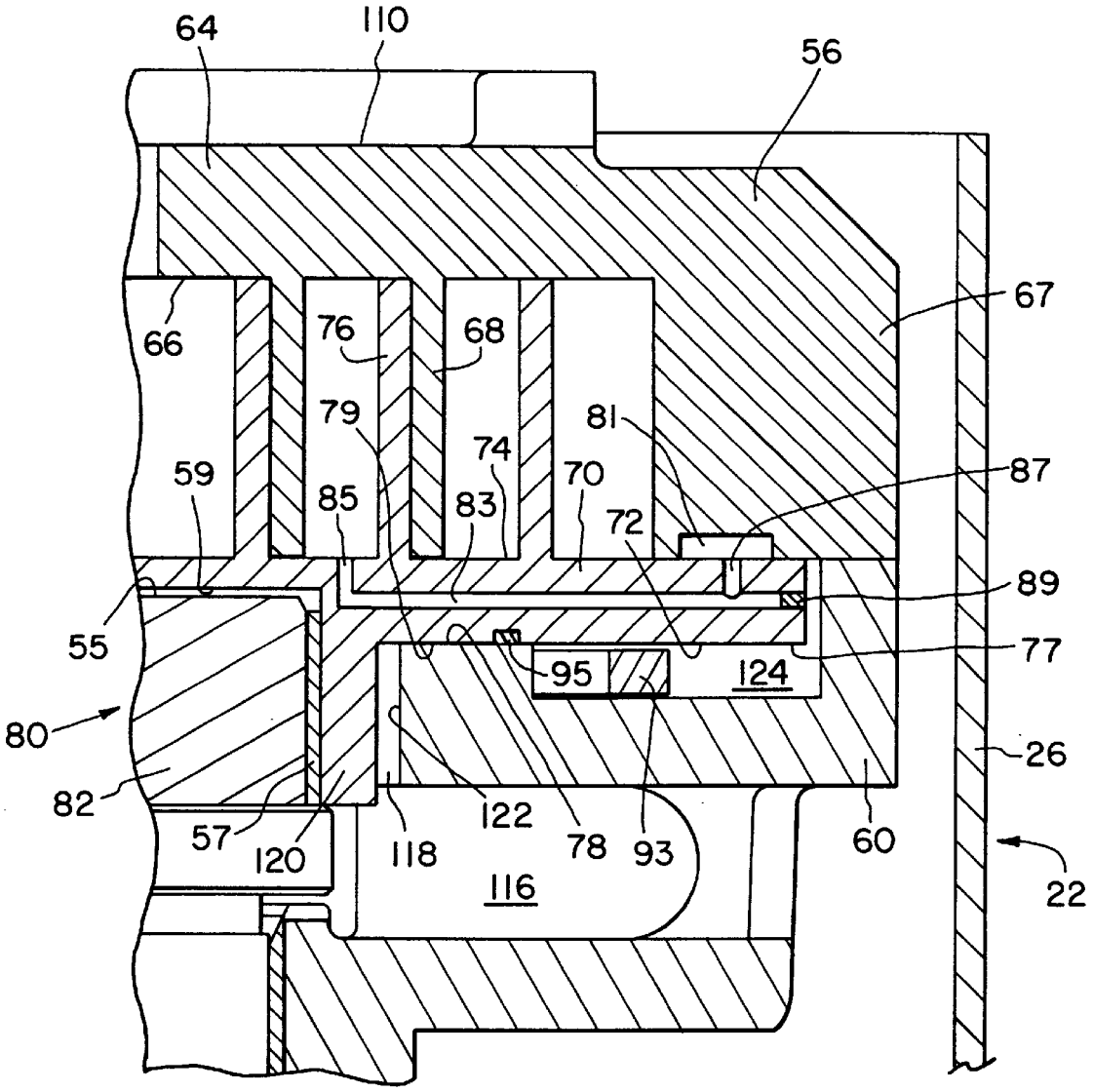
FIG. 4 is a cutaway, sectional view of the compressor mechanism of FIG. 1 showing the intermediate pressure fluid passage and annular chamber of the present invention.

As shown in FIG. 4, discharge pressure occupies annular volume 116, which extends into axial volume 118 formed between hub 120 of orbiting scroll member 58 and hub receiving bore 122 of frame 60. Fluid at discharge pressure exerts an axial biasing force against inner portion 79 of orbiting scroll back surface 72 so as to urge the orbiting scroll member upward toward fixed scroll member 56. Fluid at suction pressure, or in the alternative some pressure intermediate suction and discharge pressure, occupies outer volume 124, which is formed between frame 60, orbiting scroll member 58, and fixed scroll member 56. Seal 95 prevents the discharge pressure fluid from volume 116 from entering outer volume 124 and a seal may be disposed between intermediate pressure cavity 81 and volume 124 to prevent fluid at intermediate pressure from exiting annular chamber 81 and entering volume 124.

In one embodiment, passage 83 (FIG. 2) is provided by drilling or otherwise manufacturing a radial bore through the plate of the orbiting scroll member. Plug 89 is provided to prevent intermediate pressure fluid from escaping out the bore and to thereby contain the intermediate pressure fluid within intermediate pressure cavity 81. Once contained in cavity 81, the intermediate pressure fluid acts upon upper surface 74 of the orbiting scroll member and facing surface 75 of the fixed scroll member so as to urge the scroll members apart. In this manner, an unbiasing force is exerted between the scroll members to offset excessive axial biasing forces which may act upon the orbiting scroll member, thereby preventing excessive wear and power consumption and providing enhanced operating efficiency.

The introduction of an intermediate anti-biasing or unbiasing force acts as a cushion against excessive axial forces and provides additional control over the biasing forces to enlarge the operating envelope of the compressor. The intermediate pressure anti-biasing force effectively lessens the axial biasing force, essentially at discharge pressure, at the higher end of the operating range. In order to achieve proper conditions at the lower end of the operating range, it is important to: 1) most effectively locate seal 95 which separates the back surface into discharge and suction pressure areas, and 2) most effectively locate intermediate pressure bleed aperture 85 in the scroll set and size the area associated with intermediate pressure cavity 81 so that the discharge pressure area is sufficient at low operating pressure conditions to maintain the intimate contact between the scroll members, thereby preventing leakage.

Although there are numerous arrangements suitable to achieve the results associated with the present invention, the following provides one guide for designing an effective system. First, set or define the desired operating envelope or range of the compressor including low and high operating extremes. Second, determine optimum location of seal 95 on back of orbiting scroll member 58, this has the effect of selecting the surface area of the orbiting scroll member exposed to discharge pressure in the embodiment disclosed. The location is selected so as to provide sufficient upwards acting axial biasing force at the back surface of the orbiting scroll member to maintain axial compliance in the scroll set through the desired operating range of the compressor. Third, determine the maximum desired upwards acting axial biasing force at the high end of the operating range and set the dimensions of intermediate pressure cavity 81 and the size and location of intermediate pressure aperture 85.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A scroll compressor comprising:

a hermetically sealed housing;

a fixed scroll member disposed in said housing and including an involute fixed wrap element;

an orbiting scroll member disposed in said housing and including an involute orbiting wrap element thereon, said orbiting wrap element being intermeshed with said fixed wrap element to define therebetween at least one pocket of compression;

a drive mechanism connected to said orbiting scroll member;

an axial compliance pressure chamber containing pressurized fluid acting on one of said orbiting and fixed scroll members to urge said scroll members together;

an intermediate pressure chamber interposed between said orbiting and fixed scroll members; and at least one passageway provided in at least one of said orbiting and fixed scroll members, said at least one passageway communicating said intermediate pressure chamber with said at least one pocket of compression during compression of fluid so as to maintain the fluid pressure within said intermediate pressure chamber at a pressure level which is intermediate between the pressure at which fluid enters said at least one pocket of compression and the pressure at which fluid is discharged from said at least one pocket of compression during compressor operation, whereby fluid from said at least one pocket of compression provides an anti-biasing force within said intermediate pressure chamber acting in a direction to axially separate said scroll members.

2. The scroll compressor of claim 1, wherein said housing includes therein a discharge chamber occupied by fluid at discharge pressure.

3. The scroll compressor of claim 2, wherein fluid from said discharge chamber communicates with said axial compliance chamber to impart an axial biasing force against a back surface of said orbiting scroll member, and said axial biasing force urges said orbiting scroll member toward said fixed scroll member to effect a tight engagement between said fixed and orbiting wrap elements.

4. The scroll compressor of claim 3 further comprising a seal interposed between said intermediate chamber and said axial compliance chamber.

5. The scroll compressor of claim 3 further comprising a suction chamber occupied by fluid at suction pressure and interposed between said intermediate pressure chamber and said axial compliance chamber.

6. The scroll compressor of claim 5 further comprising a seal interposed between said suction chamber and said axial compliance chamber.

7. The scroll compressor of claim 1, further comprising a frame including a thrust surface adjacent and abutting a back surface of said orbiting scroll member.

8. The scroll compressor of claim 7, further comprising a seal interposed between said orbiting scroll member back surface and said thrust surface, said seal adapted to sealingly separate between said axial compliance chamber and a portion of said orbiting scroll member back surface exposed to fluid at a pressure less than discharge pressure.

9. The scroll compressor of claim 1, wherein said orbiting scroll member includes an end plate having a face surface and a back surface, said involute orbiting wrap element extending from said face surface.

10. The scroll compressor of claim 9, wherein said back surface includes a first area exposed to fluid at discharge pressure and a second area exposed to fluid at a pressure less than discharge pressure.

11. The scroll compressor of claim 10, wherein said face surface includes a first area in communication with fluid contained in said intermediate pressure chamber, whereby fluid contained in said intermediate pressure chamber imparts an anti-biasing force against said orbiting scroll member at said face surface in a direction away from said fixed scroll member.

12. The scroll compressor of claim 1, wherein at least a portion of said intermediate pressure chamber is provided in said orbiting scroll member.

13. The scroll compressor of claim 1, wherein at least a portion of said intermediate pressure chamber is provided in said fixed scroll member.

14. The scroll compressor of claim 1 further comprising a lubrication system including an oil sump in said housing, an oil passageway provided in said drive mechanism and having an inlet disposed in said sump and an outlet at an end of the oil passageway opposite said sump, said outlet in communication with an oil chamber formed intermediate said drive mechanism and said orbiting scroll member, wherein fluid contained in said oil chamber is essentially at discharge pressure and exerts an axial biasing force against said orbiting scroll member urging same toward said fixed scroll member.

15. A scroll compressor comprising:

a hermetically sealed housing;

a fixed scroll member in said housing including an involute fixed wrap element;

an orbiting scroll member in said housing including an end plate having a face surface and a back surface, said face surface having an involute orbiting wrap element thereon intermeshed with said fixed wrap element to define therebetween at least one pocket of compression;

a frame including a thrust surface adjacent said back surface of said orbiting scroll end plate;

a drive mechanism connected to said orbiting scroll member;

an axial compliance pressure chamber containing pressurized fluid acting on one of said orbiting and fixed scroll members to urge said scroll members together;

a seal between said orbiting scroll member and said thrust surface sealingly separating between said axial compliance chamber and a portion of said end plate back surface exposed to fluid at a pressure less than discharge pressure;

an intermediate pressure chamber interposed between said orbiting and fixed scroll members; and at least one passageway provided in at least one of said orbiting and fixed scroll members, said at least one passageway communicating said intermediate pressure chamber with said at least one pocket of compression during compression of fluid so as to maintain the fluid pressure within said intermediate pressure chamber at a pressure level which is intermediate between the pressure at which fluid enters said at least one pocket of compression and the pressure at which fluid is discharged from said at least one pocket of compression, whereby fluid from said at least one pocket of compression provides an anti-biasing force within said intermediate pressure chamber acting in a direction to axially separate said scroll members.

16. In a scroll compressor comprising a housing, an orbiting scroll member having an involute wrap element thereon, a fixed scroll member having an involute wrap element thereon, a drive mechanism connected to said orbiting scroll member, and an axial compliance pressure chamber containing pressurized fluid acting on one of said orbiting and fixed scroll members to urge the scroll members together, wherein said orbiting and fixed wrap elements are intermeshed so as to form at least one pocket of compression, an anti-biasing means comprising;

an intermediate pressure chamber interposed between said orbiting and fixed scroll members; and at least one passageway provided in at least one of said orbiting and fixed scroll members, said at least one passageway communicating said intermediate pressure chamber with said at least one pocket of compression during compression of fluid so as to maintain the fluid pressure within said intermediate pressure chamber at a pressure level which is intermediate between the pressure at which fluid enters said at least one pocket of compression and the pressure at which fluid is discharged from said at least one pocket of compression, whereby fluid from said at least one pocket of compression provides an anti-biasing force within said intermediate pressure chamber acting in a direction to axially separate said scroll members.

17. The anti-biasing means of claim 16, wherein said housing includes therein a discharge chamber occupied by fluid at discharge pressure, fluid from said discharge chamber communicates with said axial compliance chamber to impart an axial biasing force against a back surface of said orbiting scroll member, and said axial biasing force urges said orbiting scroll member toward said fixed scroll member to effect a tight engagement between said fixed and orbiting wrap elements.

18. The anti-biasing means of claim 17 further comprising a seal interposed between said intermediate chamber and said axial compliance chamber.

19. The anti-biasing means of claim 18 further comprising a suction chamber occupied by fluid at suction pressure and interposed between said intermediate pressure chamber and said axial compliance chamber.

20. The anti-biasing means of claim 16 further comprising a frame including a thrust surface adjacent and abutting a back surface of said orbiting scroll member, and a seal interposed between said orbiting scroll member back surface and said thrust surface, said seal adapted to sealingly separate between said axial compliance chamber and a portion of said orbiting scroll member back surface exposed to fluid at a pressure less than discharge pressure.

21. The anti-biasing means of claim 16, wherein said orbiting scroll member includes an end plate having a face surface from which extends said involute wrap element, and a back surface having a first area exposed to fluid at discharge pressure and a second area exposed to fluid at a pressure less than discharge pressure.

22. The anti-biasing means of claim 21, wherein said face surface includes a first area in communication with fluid contained in said intermediate pressure chamber, whereby fluid contained in said intermediate pressure chamber imparts an anti-biasing force against said orbiting scroll member at said face surface in a direction away from said fixed scroll member.

23. The anti-biasing means of claim 16 further comprising a lubrication system including an oil sump in said housing, an oil passageway provided in said drive mechanism and having an inlet disposed in said sump and an outlet at an end of the oil passageway opposite said sump, said outlet in communication with an oil chamber formed intermediate said drive mechanism and said orbiting scroll member, wherein the fluid contained in said oil chamber is essentially at discharge pressure and exerts an axial biasing force against said orbiting scroll member urging same toward said fixed scroll member.

24. A scroll compressor comprising:

a hermetically sealed housing;

a fixed scroll member disposed in said housing and including an involute fixed wrap element;

an orbiting scroll member disposed in said housing and including an involute orbiting wrap element thereon, said orbiting wrap element being intermeshed with said fixed wrap element to define therebetween at least one pocket of compression;

a drive mechanism connected to said orbiting scroll member;

an intermediate pressure chamber interposed between said orbiting scroll member and said fixed scroll member; and at least one passageway provided in at least one of said orbiting and fixed scroll members, said at least one passageway being in communication with said at least one pocket of compression and said intermediate pressure chamber, whereby fluid from said at least one pocket of compression provides an anti-biasing force within said intermediate pressure chamber acting in a direction to axially separate said scroll members.

25. The scroll compressor of claim 24, wherein said housing includes therein a axial compliance chamber occupied by fluid at discharge pressure.

26. The scroll compressor of claim 25, wherein fluid from said axial compliance chamber impart an axial biasing force against a back surface of said orbiting scroll member, and said axial biasing force urges said orbiting scroll member toward said fixed scroll member to effect a tight engagement between said fixed and orbiting wrap elements.

27. In a scroll compressor comprising a housing, an orbiting scroll member having an involute wrap element thereon, a fixed scroll member having an involute wrap element thereon, and a drive mechanism connected to the orbiting scroll member, wherein said orbiting and fixed wrap elements are intermeshed so as to form a at least one pocket of compression, an anti-biasing means comprising;

an intermediate pressure chamber interposed between said orbiting scroll member and said fixed scroll member; and at least one passageway provided in at least one of said orbiting and fixed scroll members, said at least one passageway being in communication with said at least one pocket of compression and said intermediate pressure chamber, whereby fluid from said at least one pocket of compression provides an anti-biasing force within said intermediate pressure chamber.

28. The anti-biasing means of claim 27, wherein said housing includes therein a discharge chamber occupied by fluid at discharge pressure, said fluid at discharge pressure imparts an axial biasing force against a back surface of said orbiting scroll member, and said axial biasing force urges said orbiting scroll member toward said fixed scroll member to effect a tight engagement between said fixed and orbiting wrap elements.

* * * * *

UNITED STATES PATENT AND TRADEMARK OFFICE

CERTIFICATE OF CORRECTION

PATENT NO : 6,015,277

DATED : January 11, 2000

INVENTOR(S) : Hubert Richardson, Jr.

It is certified that error appears in the above-identified patent and that said Letters Patent is hereby corrected as shown below:

Title page, item [54] and col. 1,

Delete "FABRICATION METHOD FOR SEMICONDUCTOR SUBSTRATE" and substitute therefor --MULTIPLE PRESSURE AXIAL BIAS MEANS FOR SCROLL COMRPRESSOR--

Signed and Sealed this

Twenty-sixth Day of December, 2000

*Attest:*

*Attesting Officer*

Q. TODD DICKINSON

*Director of Patents and Trademarks*